US005601060A

United States Patent [19]

Smietanski et al.

[11] Patent Number: 5,601,060

[45] Date of Patent: Feb. 11, 1997

[54] CAST OIL PAN FOR INTERNAL COMBUSTION ENGINE

[75] Inventors: Richard A. Smietanski, Lockport; Wayne R. Sidor, Northlake, both of Ill.

[73] Assignee: Navistar International Transportation Corp., Chicago, Ill.

[21] Appl. No.: 622,078

[22] Filed: Mar. 26, 1996

[51] Int. Cl.[6] ..... F01M 11/06

[52] U.S. Cl. ..... 123/195 C; 184/106

[58] Field of Search ..... 123/195 C, 198 E, 123/196 R; 184/6.5, 106

[56] References Cited

U.S. PATENT DOCUMENTS 4,479,463 10/1984 Curley et al. ..... 123/195 C 4,615,314 10/1986 Baugh ..... 123/195 C 5,136,993 8/1992 Ampferer et al. ..... 123/195 C

*Primary Examiner*—Noah P. Kamen

*Attorney, Agent, or Firm*—Dennis K. Sullivan

[57] ABSTRACT

A cast oil pan, which is reversible for front and rear sump applications, including an integral suction passage which extends the length of the pan and has outlets at either end, the suction passage including a screened intake seated in the sump area of the pan. Preferably, the bottom surface of the sump area is depressed to create a drain passage beneath the suction passage, the drain passage and bottom surface of the suction passage thereabove having aligned drain ports which are accommodated by a single plug to provide for complete drainage of the pan.

12 Claims, 2 Drawing Sheets

CAST OIL PAN FOR INTERNAL COMBUSTION ENGINE

BACKGROUND OF THE INVENTION

The present invention relates to a cast engine oil pan for an internal combustion engine which is designed to facilitate draining of the entire oil pan while maintaining a seal between the sump and the pickup tube, the pan having a particular configuration of integral passages therein to allow for reversibility of the pan to accommodate for front or rear sump applications.

THE PRIOR ART

Commonly, internal combustion engines employ a separate pick-up tube completely divorced from the oil pan. Such a pick-up tube is manufactured from multiple components and is then attached to the engine using a separate gasket or seal and required fasteners. Some engine oil pans have been manufactured that incorporate some form of integral oil pick-up tube or passage. Most such attempts have in fact used a separate tube that is welded or otherwise attached permanently to the oil pan. As such these previous designs do little to reduce either the total numbers of components, the number of possible leak paths, or the alignment difficulties associated with multiple components.

In U.S. Pat. No. 4,479,463, there is provided a reversible oil pan having a pair of integrally cast vertical suction passage which are located in the side walls of the pan and which have upwardly opening galleries extending from the vertical passages to diagonally opposite corners of the pan for engagement with a pick-up channel in the crankcase. However, the upward opening galleries would appear to present a sealing problem, potentially resulting in the oil pump starvation.

SUMMARY OF THE INVENTION

Accordingly, it is a primary object of the invention described and claimed herein to provide an oil pan for an internal combustion engine having cast, integral oil pick-up passages, thereby producing a one piece design and reducing the number of potential leak points and assembly alignment issues.

Another object of the invention is to provide an oil pan having cast passages which is reversible to accommodate front and rear sump applications.

A further object of the invention is to provide an oil pan incorporating structure therein which prevents sludge accumulating at the bottom of the oil pan from being ingested into the engine.

Still another object of the invention is to provide an oil pan having the passages arranged to allow all fluid chambers to be completely drained by means of a single drain plug.

These and other objects are specifically met by the cast oil pan of the present invention wherein a suction passage is integrally formed in the oil pan and extends to outlets disposed respectively at a transversely centered position at each end of the oil pan. The suction passage has screened window inlets disposed in the sump portion of the pan adjacently above the bottom surface to permit coarsely filtered oil to enter the suction passage. A drain passage is further integrally cast in the oil pan below the suction passage in the region of the drain plug and a drain hole extends between the suction passage and the drain passage to permit the suction passage to be drained along with the oil in the sump. A single drain plug seals both a drain hole in the bottom of the drain passage of the oil pan and the drain hole between the bottom of the suction passage and the drain passage to prevent solids accumulating in the drain passage from being ingested into the engine through the suction passage.

BRIEF DESCRIPTION OF THE DRAWINGS

Other objects and advantages of the invention will become more apparent upon perusal of the detailed description thereof and upon inspection of the drawings in which.

DESCRIPTION OF THE PREFERRED EMBODIMENT

Figure 1:
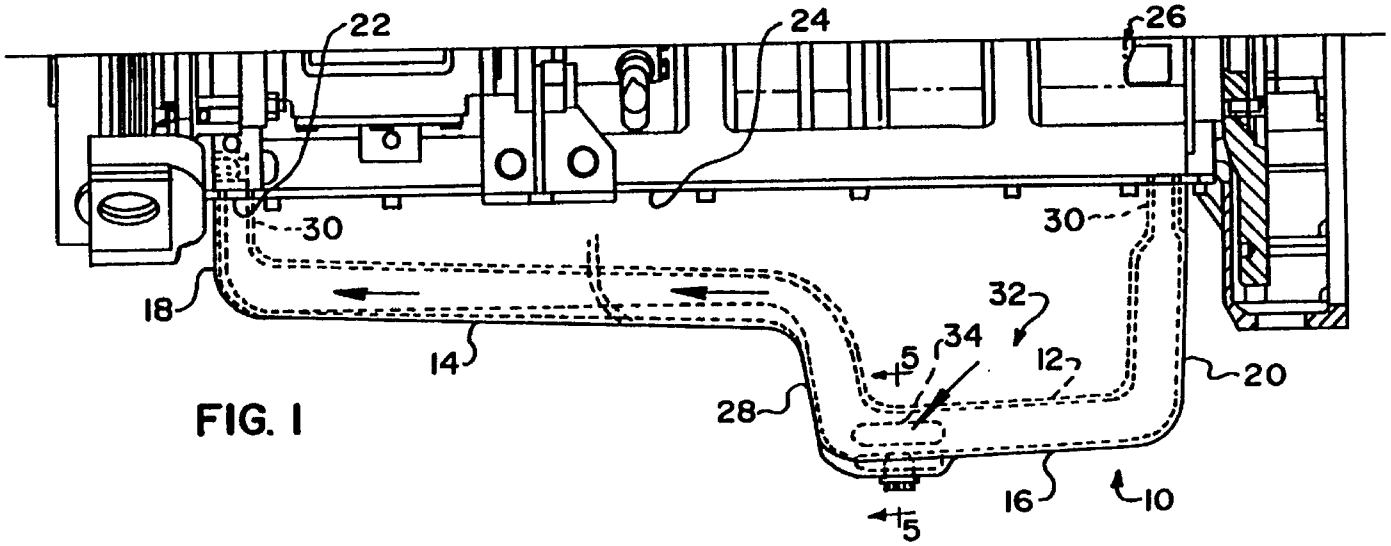
FIG. 1 is a side view through an oil pan made in accordance with the teachings of the present invention shown mounted to a portion of an internal combustion engine in a rear sump position.

Referring now to the drawings in greater detail, there is illustrated in the drawings a reversible, completely drainable, cast oil pan for an internal combustion engine made in accordance with the teachings of the present invention and generally identified by the reference numeral 10.

Figure 2:
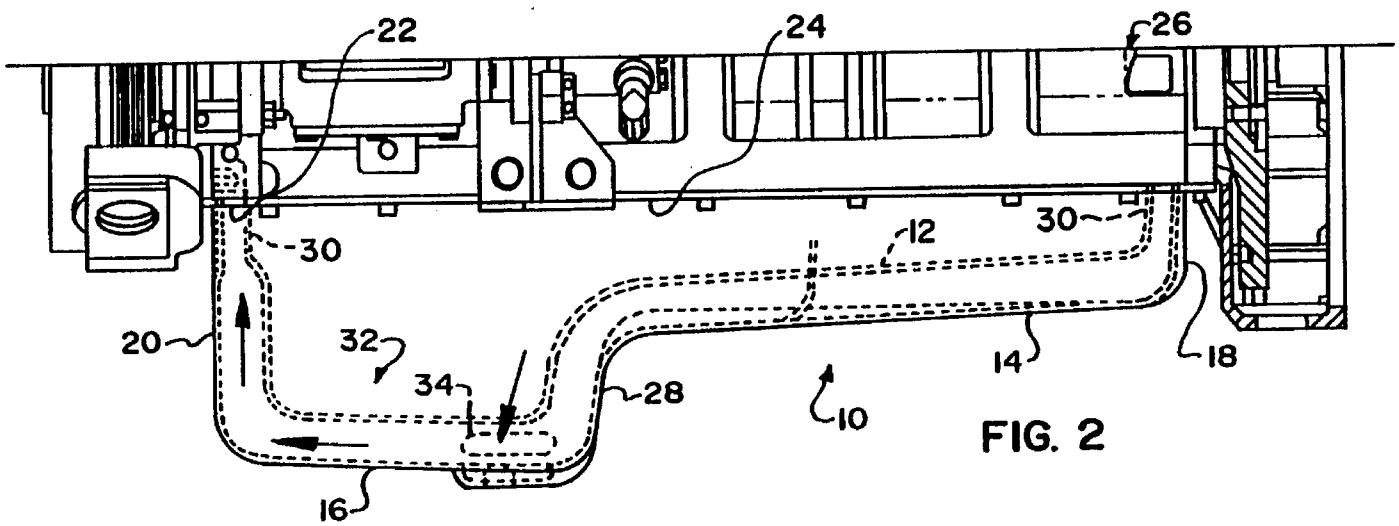
FIG. 2 is a side view through an oil pan made in accordance with the teachings of the present invention shown mounted to a portion of an internal combustion engine in a front sump position.

As shown in FIGS. 1 and 2, the oil pan 10 may be used for front sump applications as well as rear sump applications by merely reversing its longitudinal alignment relative to the engine crankcase generally identified as 26. Such reversibility is provided by the provision of a transversely-centered suction passage 12 integrally cast into the oil pan 10 which runs along the bottom surface 28 thereof the length of the pan 10 from a shallow end 14 to a deep sump end 16 thereof and up the interior sides of end walls 18 and 20, respectively, to form an oil outlet 30 at each end of the suction passage 12, one of which communicates with an oil pump oil intake 22 in a bottom surface 24 of an engine 26 and the other of which may be open.

The suction passage 12 is a hollow cast tubular structure having its bottom wall in most places coincident with the bottom surface 28 of the pan 10. However, as best seen in FIG. 5, in the lowermost oil holding or sump area 32 at the sump end 16 of the oil pan, a drain passage 42 to be discussed below is cast between the suction passage 12 and the bottom surface 28 of the oil pan.

To provide access for oil entrained within the sump area 32 to enter into the suction passage 12, at least one window inlet 34 is provided in the side portions 40 of wall 36 defining the hollow tubular sump passage 12 at a selected level adjacently above the bottom surface 28 of the oil pan 10 but substantially below the normal oil level in the sump area 16. Since the oil collected in this sump area may contain larger particulates and metal debris which should not enter the engine oil pump, the window inlet 34 is covered with mesh screen 38 (FIG. 4) to provide a strainer to keep such larger particulates and metal debris from being sucked into the passage 12. Further, the window 34 is set a predetermined height above the bottom surface 28 of the oil pan to keep as much sludge as possible from being sucked into the engine 26 as well. In the particular embodiment disclosed, the passage 12 is shown to have a generally rectangular cross-section, and a screened window 34 is provided in each sidewall 40 of the passage 12.

Figure 3:
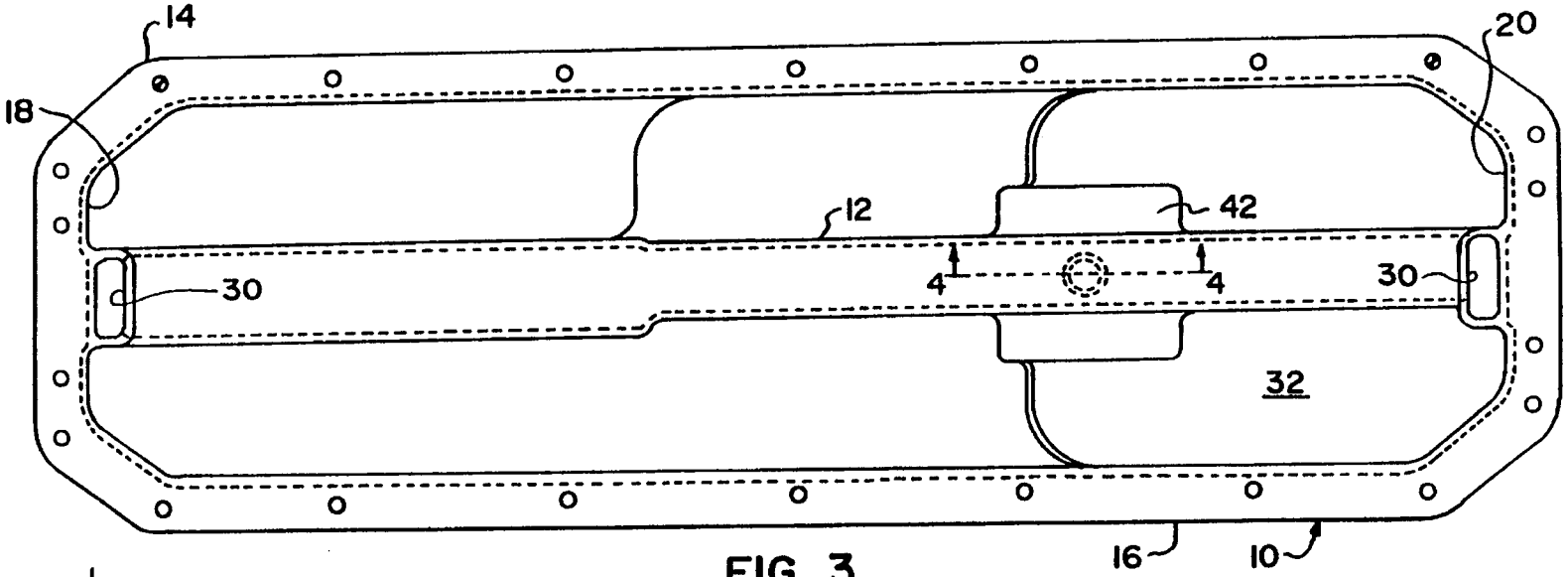
FIG. 3 is a plan view of the oil pan of the present invention.

From looking at FIGS. 3, it will be seen that the suction passage 12 divides the bottom surface 28 of the oil pan 10 into two halves up to the vertical extent of the suction passage 12. This poses a problem in the sump area 32 when oil is to be completely drained from the pan 10. In this respect, oil must be drained from the suction passage 12 in the area below the window and must also be drained from the sump area 32 to either side of the passage 12.

Figure 5:
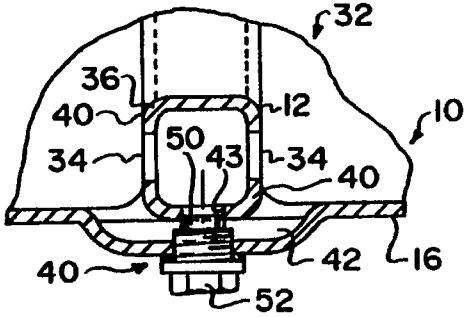
FIG. 5 is a transverse cross-section through the oil pan channel incorporating the plug and taken along the line 5—5 of FIG. 1.
Figure 4:
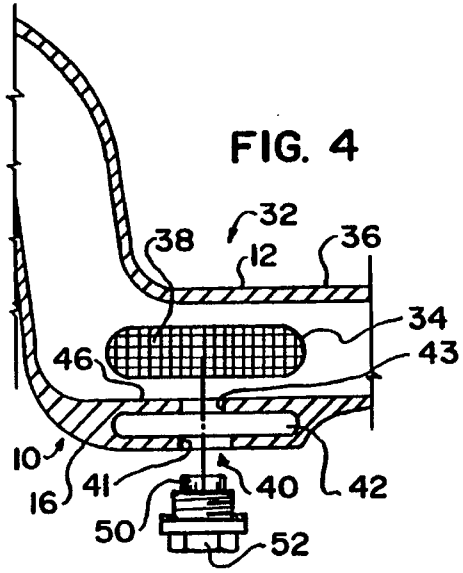
FIG. 4 is a longitudinal partly-exploded cross-section through a portion of the oil pan channel incorporating the plug taken along the line 4—4 of FIG. 3.

As shown in FIGS. 4 and 5, the problem presented is simply alleviated in the present embodiment of the pan 10, by providing a single, tiered, drain port configuration 40 including the drain passage 42 beneath the suction passage 12 which empties the pan 10 entirely, and a drain hole 43 which empties the entire content of the passage 12.

In this respect, in the sump area 32 of the pan 10, a drain passage 42 is created which extends to either side of the passage 12, tunneling under the passage 12 and terminates centrally therebeneath in a drain port 41 which is disposed directly beneath and in axial alignment with a cooperating drain port 43 of smaller diameter provided in a bottom wall 46 of the passage wall 36 in the area above the drain passage 42.

Thus, a single drain plug 52 can be used for engaging the tiered port configuration 40, the port 41 of the depression 42 being sealed completely and the port 43 of the passage 12 merely being closed off without sealing by the insertion of the end 50 of the plug 52 thereinto to keep sludge and debris on the bottom of the oil pan from being sucked into the suction passage 12. The drain plug 50 may be of a conventional magnetic type configured to accommodate the tiered port configuration 40.

Thus, a completely drainable, reversible cast oil pan is provided which has an integrally cast oil pick-up passage thereby resulting in a one-piece design, eliminating separate additional components previously required and assembly alignment issues associated therewith and reducing the possible points of leakage. It will be evident to those of ordinary skill in the art that various modifications and alterations may be made in the embodiment of the invention disclosed herein without departing from the inventive teaching herein. Accordingly, the scope of the invention is only to be limited as necessitated by the accompanying claims.

What is claimed is:

1. A reversible, completely drainable oil pan for accommodating front and rear sump applications, the oil pan including a transversely centered, longitudinally extending integrally cast suction passage having a screened intake disposed within a sump area of the oil pan and terminating in upwardly facing outlets of substantially the same area as the suction passage disposed respectively at each end of the oil pan.

2. The invention in accordance with claim 1 further including a drain passage disposed beneath said suction passage in the sump area and a drain hole disposed in said drain passage and opening to the exterior of said oil pan.

3. The invention in accordance with claim 2 further including a drain aperture disposed between said suction passage and said drain passage, said drain aperture being disposed in axial alignment with said drain hole.

4. The invention in accordance with claim 2 further including a drain plug disposed in sealing engagement in said drain hole, said drain plug having an end disposed in closing relationship with said drain aperture.

5. The invention in accordance with claim 1 wherein the said suction passage is defined by a substantially rectangular cross-section tubular structure which extends along the bottom surface of the pan and extends up each longitudinal end wall of the pan.

6. The invention in accordance with claim 5 wherein the suction passage has two upwardly extending side walls and a screened intake is disposed at a predetermined spacing above a bottom surface of said pan in said sump area in each upwardly extending side wall of the rectangular cross-section tubular structure.

7. A cast oil pan comprising an upwardly opening U-shaped body having an interior bottom surface including a sump area for collecting oil, an integrally cast suction passage disposed along said bottom surface and having an intake port disposed within said sump area and an upwardly-opening outlet port disposed along an upper edge of a wall of said body, and a drain passage disposed beneath said suction passage in the sump area.

8. The invention in accordance with claim 7 wherein the drain passage defines the lowermost portion of said sump area and a drain hole is disposed in said drain passage and opens to the exterior of said oil pan.

9. The invention in accordance with claim 8 further including a drain aperture disposed between said suction passage and said drain passage, said drain aperture being disposed in axial alignment with said drain hole.

10. The pan of claim 8 wherein said intake port is screened.

11. A completely drainable oil pan having a longitudinal suction passage integrally cast therein, the passage having a screened port leading thereinto in a portion of the passage within a sump area of the pan, the pan sump area having a depression therein which forms a tunnel beneath the suction passage, the tunnel and passage being completely drainable and sealed by a single plug which engages within tiered ports disposed respectively in the bottom surface of said tunnel and in an overlying suction passage wall.

12. In combination with an internal combustion engine having a lubricating system including an oil intake passage, a completely drainable oil pan comprising an integrally cast suction passage having a screened intake disposed within a sump area of the pan and terminating in an outlet disposed to establish sealed communication with said lubricating system oil intake passage, a bottom surface portion of the sump area including a drain passage therein which creates a cavity beneath a portion of said suction passage, said drain passage and said suction passage each having a drain port disposed in a lowermost portion thereof, said drain ports being disposed in vertical alignment, and a single drain plug for closing each of said drain ports.

* * * * *